US009609941B2

(12) United States Patent
Ragosta et al.

(10) Patent No.: US 9,609,941 B2
(45) **Date of Patent: *Apr. 4, 2017**

(54) HAIR STYLING TOOL WITH MOVABLE DIVIDERS

(71) Applicant: M. M. & R. PRODUCTS, INC., Calabasas, CA (US)

(72) Inventors: Michael A. Ragosta, Calabasas, CA (US); Claudio Marino, Woodland Hills, CA (US); Bruno Meglio, Beverly Hills, CA (US); David J. Richmond, Culver City, CA (US); Howard C. Richmond, Los Angeles, CA (US)

(73) Assignee: M. M. & R. Products, Inc., Calabasas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/051,607

(22) Filed: Feb. 23, 2016

(65) Prior Publication Data

US 2016/0166053 A1 Jun. 16, 2016

Related U.S. Application Data

(63) Continuation of application No. 14/798,444, filed on Jul. 13, 2015, now Pat. No. 9,289,054, which is a (Continued)

(51) Int. Cl.
*A46B 13/02* (2006.01)
*A45D 20/48* (2006.01)

(Continued)

(52) U.S. Cl.
CPC ..... *A46B 13/02* (2013.01); *A45D 2/002* (2013.01); *A45D 7/02* (2013.01); *A45D 20/50* (2013.01);

(Continued)

(58) Field of Classification Search
CPC ..... A45D 24/007; A45D 24/10; A45D 20/48; A45D 20/50; A46B 13/02; A46B 13/001;

(Continued)

(56) References Cited

U.S. PATENT DOCUMENTS 54,695 A 5/1866 Crosman
431,497 A 7/1890 Walker (Continued)

FOREIGN PATENT DOCUMENTS

AL 00/69307 A1 11/2000
AU 2012205501 9/2016

(Continued)

OTHER PUBLICATIONS

MM&R Products, Inc., International Search Report and Written Opinion issued in related International Patent Application No. PCT/US2012/021131; Korean Intellectual Property Office (KIPO), Aug. 29, 2012, 8 pages.

(Continued)

*Primary Examiner* — Tatiana Nobrega
(74) *Attorney, Agent, or Firm* — Laura M. Lloyd; Leech Tishman Fuscaldo & Lampl

(57) ABSTRACT

A hair styling tool having a plurality of bristles and one or more movable members extending radially outward from the core and movable between opposing positions is provided. The movable members move between a retracted position where the divider is fitted between and even with or slightly above or slightly below the bristles to engage the hair and an extended position where the divider is moved out beyond the bristles to disengage the hair from the bristles. The hair styling tool having the movable member which engages and disengages the hair with the bristles minimizes tangling of the hair while brushing. The hair styling tool may be a rotating brush optionally equipped with a motor.

25 Claims, 7 Drawing Sheets

Related U.S. Application Data continuation of application No. 13/973,593, filed on Aug. 22, 2013, now Pat. No. 9,107,492, which is a continuation of application No. 13/005,468, filed on Jan. 12, 2011, now Pat. No. 8,573,231.

(51) Int. Cl.

| | |
|---|---|
| ***A45D 20/50*** | (2006.01) |
| ***A46B 13/00*** | (2006.01) |
| ***A46B 9/02*** | (2006.01) |
| ***A45D 2/00*** | (2006.01) |
| ***A45D 7/02*** | (2006.01) |
| *A45D 24/00* | (2006.01) |

(52) U.S. Cl.

CPC ..... *A46B 9/023* (2013.01); *A46B 13/001* (2013.01); *A46B 13/005* (2013.01); *A45D 24/007* (2013.01); *A46B 2200/104* (2013.01)

(58) Field of Classification Search

CPC ..... A46B 13/08; A46B 13/005; A46B 9/023; A46B 9/026; A46B 2200/10; A46B 2200/104

USPC .... 132/223, 226, 227, 229, 230, 118, 119.1, 132/120, 236, 126–129, 131, 144, 237, 132/238, 240, 241, 122, 123, 148; 15/23, 15/25–27, 105, 110, 160, 179, 201; 119/600, 608, 609, 611–616, 618, 119/625–633, 664; D28/24, 25, 28, 37, D28/38; D4/102, 116, 118, 121, 128, D4/137; D30/150, 156

See application file for complete search history.

(56) References Cited

U.S. PATENT DOCUMENTS

| | | | | | |
|---|---|---|---|---|---|
| 524,654 | A | * | 8/1894 | Shute | A46B 13/001 15/179 |
| 1,572,161 | A | | 2/1926 | Russell | |
| 1,672,469 | A | | 6/1928 | Oshman et al. | |
| 1,889,227 | A | | 11/1932 | Sterling | |
| 2,168,235 | A | | 8/1939 | Oshman et al. | |
| 2,419,777 | A | * | 4/1947 | Howe | A45D 20/48 132/118 |
| 2,529,927 | A | | 11/1950 | Fisk | |
| 3,019,463 | A | | 2/1962 | Mitchell | |
| 3,128,487 | A | | 4/1964 | Vallis | |
| 3,150,393 | A | | 9/1964 | Taylor et al. | |
| RE25,898 | E | * | 11/1965 | Taylor et al. | A46B 13/02 15/23 |
| 3,431,571 | A | | 3/1969 | Kraus | |
| 3,491,774 | A | | 1/1970 | Carbone | |
| 3,890,984 | A | * | 6/1975 | Lesetar | A46B 13/02 132/238 |
| 3,894,547 | A | | 7/1975 | Scivoletto et al. | |
| 3,894,549 | A | * | 7/1975 | Scivoletto | A45D 20/50 132/118 |
| 3,909,868 | A | | 10/1975 | Nogues et al. | |
| 3,947,910 | A | | 4/1976 | Akerman | |
| 4,001,910 | A | | 1/1977 | Peilet | |
| 4,023,578 | A | * | 5/1977 | Buhler | A45D 20/50 132/269 |
| 4,084,282 | A | | 4/1978 | Calvert et al. | |
| 4,161,050 | A | | 7/1979 | Sasaki et al. | |
| 4,197,608 | A | | 4/1980 | Holley | |
| 4,250,902 | A | * | 2/1981 | Ihara | A45D 20/50 132/271 |
| 4,329,567 | A | | 5/1982 | Kunz et al. | |
| 4,443,688 | A | | 4/1984 | Andis et al. | |
| 4,591,695 | A | | 5/1986 | Inoue | |
| 4,656,684 | A | | 4/1987 | Jewett | |
| 4,664,132 | A | | 5/1987 | Schillig | |
| 4,944,319 | A | | 7/1990 | Trombley | |
| 5,212,366 | A | | 5/1993 | McDougall | |
| 5,584,088 | A | | 12/1996 | Pauldine | |
| 5,660,191 | A | | 8/1997 | Bontoux et al. | |
| 5,673,710 | A | | 10/1997 | Schaefer et al. | |
| 5,815,877 | A | | 10/1998 | Heneveld | |
| 5,992,423 | A | | 11/1999 | Tevolini | |
| 6,098,635 | A | * | 8/2000 | Marino | A46B 9/023 132/226 |
| D465,654 | S | | 11/2002 | Richmond et al. | |
| D466,693 | S | | 12/2002 | Richmond et al. | |
| 6,672,313 | B2 | | 1/2004 | Battaglia et al. | |
| 7,124,763 | B2 | | 10/2006 | Hafemann | |
| 7,264,004 | B2 | | 9/2007 | Djulbegovic | |
| 7,389,779 | B2 | | 6/2008 | Chan | |
| 7,481,228 | B2 | | 1/2009 | Ragosta | |
| 7,631,646 | B2 | | 12/2009 | Ragosta et al. | |
| 7,814,602 | B2 | | 10/2010 | Stydahar | |
| 8,132,541 | B1 | | 3/2012 | Baer, Jr. | |
| 2003/0131865 | A1 | * | 7/2003 | Richmond | A46B 9/021 132/119.1 |
| 2004/0200495 | A1 | * | 10/2004 | Lin | A46B 13/001 132/119.1 |
| 2004/0231077 | A1 | | 11/2004 | Richmond | |
| 2006/0278251 | A1 | | 12/2006 | Hur | |
| 2007/0169787 | A1 | * | 7/2007 | Kim | A45D 20/525 132/241 |
| 2008/0041406 | A1 | * | 2/2008 | Le | A45D 7/02 132/211 |
| 2009/0194119 | A1 | * | 8/2009 | Albrecht | A46B 17/06 132/119 |
| 2010/0043818 | A1 | | 2/2010 | Ragosta et al. | |
| 2010/0242983 | A1 | | 9/2010 | Richmond et al. | |
| 2010/0251499 | A1 | | 10/2010 | Bigio | |

FOREIGN PATENT DOCUMENTS

| | | | |
|---|---|---|---|
| CN | 201360660 | Y | 12/2009 |
| CN | ZL2012800130057 | | 8/2016 |
| JP | 2004-254897 | A | 9/2004 |
| JP | 4312470 | B2 | 5/2009 |
| MX | 339342 | | 5/2016 |
| NZ | 613817 | | 1/2012 |

OTHER PUBLICATIONS

MM&R Products, Inc., International Preliminary Report on Patentability issued in related International Patent Application No. PCT/US2012/021131; Korean Intellectual Property Office (KIPO), Jul. 16, 2013, 4 pages.

Ragosta et al., First Office Action on the Merits issued in related U.S. Appl. No. 13/005,468; United States Patent and Trademark Office, Jul. 2, 2012, 30 pages.

MM&R Products, Inc., First Office Action on the Merits issued in related U.S. Appl. No. 13/973,593; United States Patent and Trademark Office, Oct. 23, 2014, 25 pages.

MM&R Products, Inc., First Office Action issued in related Chinese Patent Application No. 2012800130051; State Intellectual Property Office, Jun. 26, 2015.

MM&R Products, Inc., First Office Action issued in related New Zealand Patent Application No. 613817; New Zealand Intellectual Property Office, Dec. 6, 2013, 2 pages.

MM&R Products, Inc., Second Office Action issued in related New Zealand Patent Application No. 613817; New Zealand Intellectual Property Office, Mar. 6, 2014, 2 pages.

MM&R Products, Inc., First Office Action issued in related Mexican Patent Application No. Mx/a/2013/007999, Mexican Institute of Industrial Property (IMPI), May 27, 2015, 3 pages.

M. M. & R Products, Inc., Examination Report issued in related Australian Patent Application No. 2012205501; Australian Patent Office, Sep. 10, 2015 4 pages.

M. M. & R Products, Inc., Examination Report issued in related Indian Patent Application No. 7991/DELNP/2008; Indian Patent Office, Sep. 10, 2015, 2 pages.

(56) References Cited

OTHER PUBLICATIONS

UKIPO, Examination Report issued in related Great Britain Patent Application No. GB1314158.5 on Apr. 27, 2016, 5 pages.
UKIPO, Further Examination Report issued in related Great Britain Patent Application No. GB1314158.5 on Aug. 25, 2016, 5 pages.

* cited by examiner

HAIR STYLING TOOL WITH MOVABLE DIVIDERS

CROSS-REFERENCE TO RELATED APPLICATIONS

The present Application is a continuation of U.S. patent application Ser. No. 14/798,444 titled "Hair Styling Tool With Movable Dividers," filed Jul. 13, 2015, which is a continuation of U.S. patent application Ser. No. 13/973,593 titled "Hair Styling Tool With Movable Dividers," filed Aug. 22, 2013, now U.S. Pat. No. 9,107,492 issued on Aug. 18, 2015, which is a continuation of U.S. patent application Ser. No. 13/005,468 titled "Hair Styling Tool With Movable Dividers," filed Jan. 12, 2011, now U.S. Pat. No. 8,573,231, issued on Nov. 5, 2013, the contents of which are incorporated in this disclosure by reference in their entirety.

BACKGROUND

Brushing hair smoothes hair cuticles, as well as pulls oil from the scalp and spreads it throughout the hair. This adds body and sheen to the hair, and keeps hair healthier. Many people blow dry their hair while simultaneously brushing their hair, known as a blowout. When simultaneously blow drying and brushing hair, preferable results are achieved by pulling the bristles of a hair brush through the hair while heat, such as hot air from a blow dryer, is applied to the hair. Hair is blown out in sections while turning the brush partially and moving the brush through the hair. A user can usually rotate a brush about one half turn manually, and after each half turn, the user pulls the brush from the hair. The brush is then placed on a new section of hair, usually adjacent to the preceding location, and the process is repeated throughout the entire head of hair.

When proper tension is placed on the hair with a brush, the hair is elongated, and when heat is applied during a blowout, even frizzy and otherwise unmanageable hair can achieve a sleek, glossy appearance, which can last for several days. However, blow drying an entire head of hair with professional looking results can be difficult on one's own head of hair, as it is difficult to reach the back of the hair while coordinating the brush movements and applying heat from a blow dryer. Professional hair stylists can accomplish these moves more easily, but a professional blow dry can be costly and is unaffordable to most people on a regular basis.

Various brushes, including rotating brushes, are known which address the difficulties associated with blow drying hair and seek to maximize the benefits of brushing hair while drying with heat. See, for example, U.S. Pat. No. 6,098,635. Disadvantageously, however, these brushes can lead to hair tangling for an inexperienced user, especially for longer hair, hair that is improperly sectioned, or improper brush positioning by the user.

Therefore, there is a need for a brush that will efficiently smooth hair cuticles and move oils from the scalp to the ends of the hair to provide a sleek, glossy blowout. There is also a need for a brush that can give professional looking blowout results and that is effectively brushed without tangling.

SUMMARY

According to the present invention, there is provided a hair styling tool that satisfies the above-identified needs. The hair styling tool is a brush with movable dividers that eliminates tangling regardless of the section size of the hair being dried, the hair length, and/or brush placement. The brush has bristles which engage the hair and provide tension when the brush is moved through the hair, either by mechanical or manual rotation. The brush also has movable dividers that move between extended and non-extended (i.e., retracted) positions as the brush rotates. When the brush rotates, the hair that is intended to be brushed encounters a divider in a non-extended position which allows the bristles to freely engage with the hair. The opposite end of the divider is positioned in its extended position, which pushes out any hair currently engaged in the adjacent bristles, which prevents the bristles from engaging any hair in the immediate area. In this manner, the brush bristles engage and disengage hair as the brush rotates and the divider moves from fully extended to non-extended, relative to the bristles (or core of the brush). The hair styling tool with a movable divider thus affords a brush that can effectively brush hair, under rotation, without tangling.

According to one version, the invention comprises a hair styling tool having a handle which is attached to a core having a longitudinal axis, and a plurality of projections, such as bristles, extending radially outwardly from the core a first distance from the longitudinal axis. The hair styling tool also has one or more movable members having a distal surface which extend radially outward from the core and move between opposing positions. The opposing positions include a retracted position where the distal surface of the movable member is distant radially from the longitudinal axis at a second distance that is less than the first distance, and an extended position where the distal surface of the movable member is distant radially from the longitudinal axis at a third distance that is more than the second distance.

The hair styling tool may comprise first and second movable members where the movable members are connected and positioned at opposing sides of the core, and movable together with respect to the core. According to this version, when the first movable member is positioned in the extended position, the second movable member is positioned in the retracted position, and when the second movable member is positioned in the extended position, the first movable member is positioned in the retracted position, and the pair of movable members are movable together between the opposing positions. According to another version, the hair styling tool may comprise two or more pairs of movable members, where each pair of movable members is connected and positioned at opposing sides of the core, and movable with respect to the core.

According to another version, the invention comprises a rotating hair brush having a handle and a core attached to the handle, where the core has a longitudinal axis and a plurality of projections which extend radially outward from the core at a first distance from the longitudinal axis. The rotating hair brush also has first and second movable members, each movable member having a distal surface which extends radially outward from the core and moves between opposing positions. The opposing positions include a retracted position where the distal surface of the movable member is distant radially from the longitudinal axis at a second distance that is less than the first distance, and an extended position where the distal surface of the movable member is distant radially from the longitudinal axis at a third distance that is more than the second distance. This version of the invention further includes means for rotating the core about its longitudinal axis relative to the handle, such as a motor.

According to another version, the invention comprises a rotating hair brush having a movable member, as described herein and further comprises a heating means. In one example, the heating means comprises a heating element.

The heating element may be within or integral with the core such that the core may be heated while the rotating hair brush is in use. In another example, the heating means comprises a heated blower. The heated blower may be within or integral with the handle, or otherwise situated to provide hot air venting out the core or otherwise venting out hot air such that the hair is heated with hot air while the rotating hair brush is in use.

According to another version, the invention comprises a method of brushing hair comprising the steps of placing the projections of the hair styling tool in a section of hair. Then, before or after the hair is placed in the projections, the rotating means is operated to cause the core to rotate. Then, the projections are pulled through the hair with the core rotating, where the movable member moves between its extended position and retracted position so that in the extended position, the movable member pushes hair away from the bristles to move hair away from the bristles and to keep hair from tangling in the projections.

BRIEF DESCRIPTION OF THE DRAWINGS

These and other features, aspects, and advantages of the present invention will become better understood with regard to the following description, appended claims, and accompanying drawings where:

DESCRIPTION

According to one version of the present invention, there is provided a hair styling tool for greatly reducing or eliminating tangling when brushing hair. The hair styling tool comprises a handle and a brush head and at least one movable member. The movable member moves between an extended position and a retracted position. The bristles of the brush engage the hair when the movable member is in the retracted position, and the movable member pushes hair away from the bristles of the brush portion of the tool when the movable member is in the extended position. The extending and retracting action of the movable member disengages hair from the bristles thus effectively brushing hair while minimizing tangling.

Figure 1:
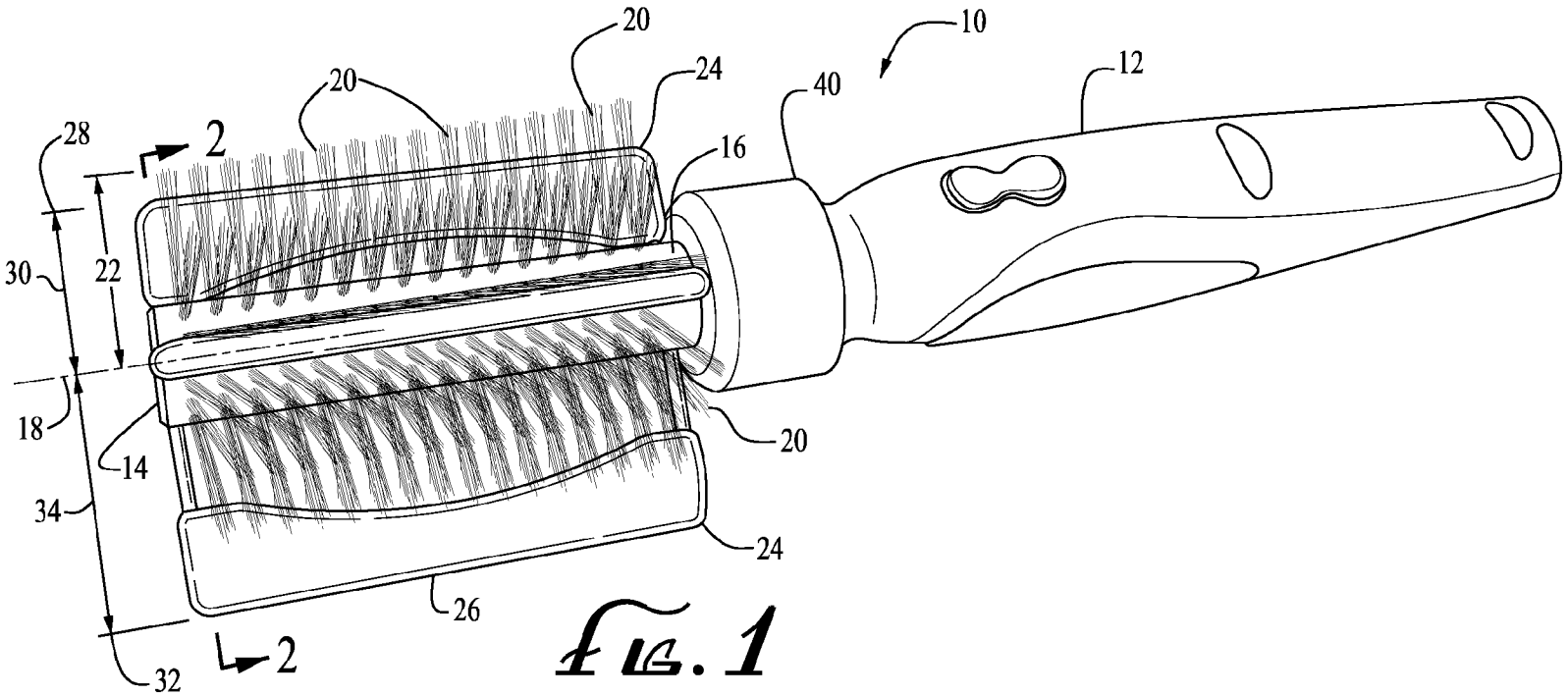
FIG. 1 is a perspective view of a hair styling tool having features of the present invention which is used for styling hair.

Referring now to FIG. 1, a perspective view of a hair styling tool 10 having features of the present invention is shown. The hair styling tool 10 comprises a handle 12 and a brush end 14, which also may be referred to as a brush, brush end, or brush portion. The brush end 14 is attached to the handle 12 and comprises a core 16 having a longitudinal axis 18 and a plurality of projections 20 that extend radially outward from the core 16 at a first distance 22 from the longitudinal axis 18. The hair styling tool 10 has at least one movable member 24 having a distal surface 26. Preferably, the distal surface of at least one movable member 24 extends substantially the entire length of the core 16.

The movable member 24 extends radially outwardly from the core 16 and is movable between opposing positions. The movable member 24 moves between a retracted position 28, where the distal surface 26 of the movable member 24 is distant radially from the longitudinal axis 18 at a second distance 30 that is less than the first distance 22, and an extended position 32, where the distal surface 26 of the movable member 24 is distant radially from the longitudinal axis 18 at a third distance 34 that is more than the first distance 22. The hair styling tool 10 has at least one and preferably up to eight or more movable members 24.

Figure 2B:
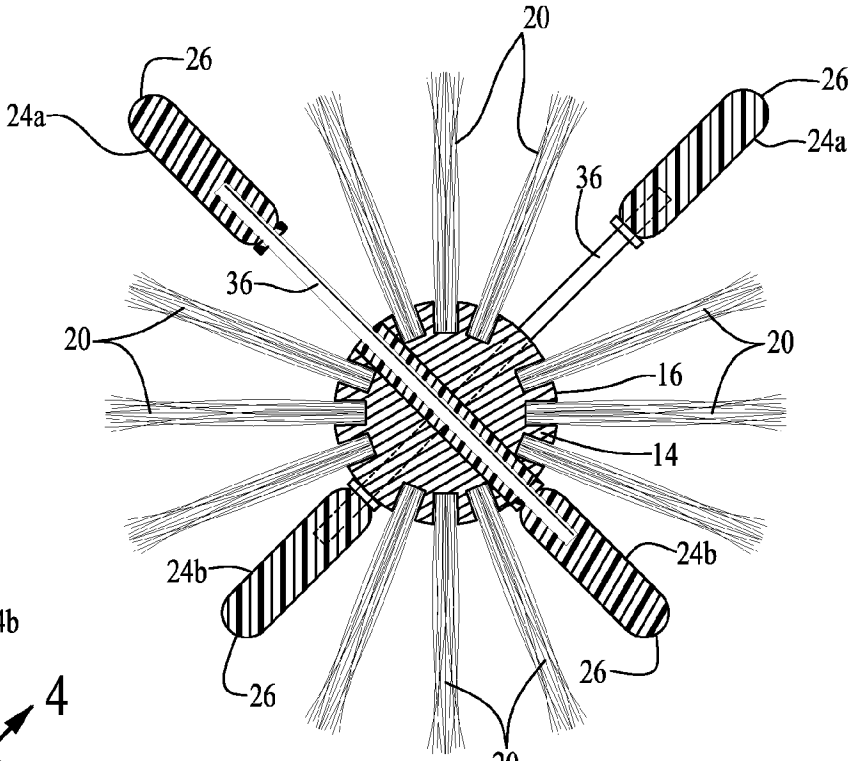
FIG. 2B is a sectional view of the hair styling tool of FIG. 2A, taken through line 2-2 of FIG. 1, showing the movable members in the opposing position.
Figure 2A:
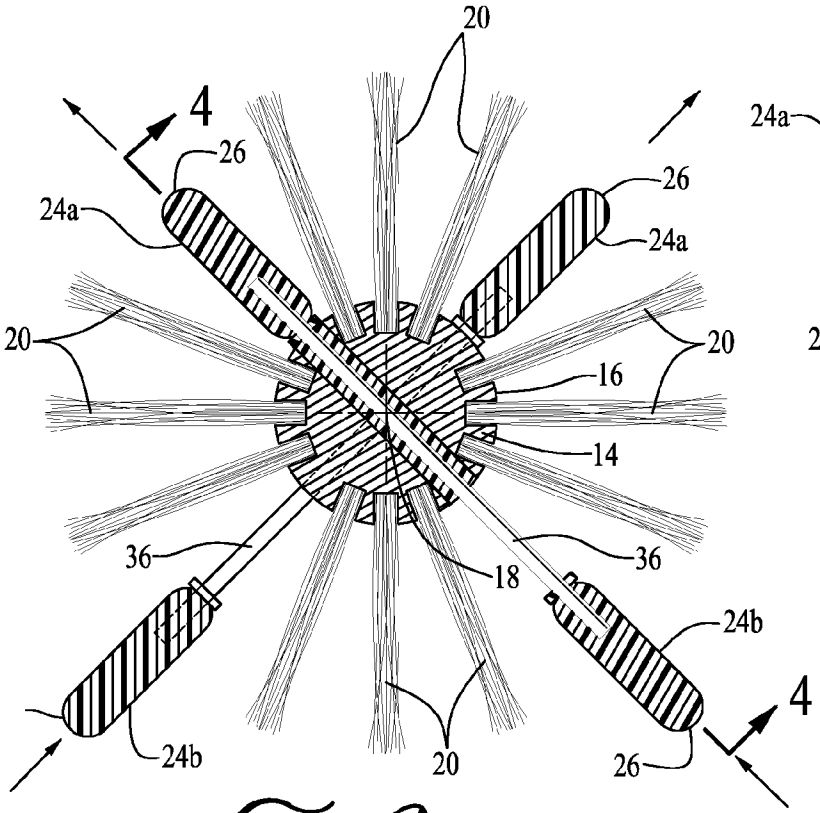
FIG. 2A is a sectional view of a hair styling tool of FIG. 1, taken through line 2-2 of FIG. 1, showing the movable members in one position.

Referring now to FIGS. 2A and 2B, a sectional view of the hair styling tool of FIG. 1 taken through line 2-2 of FIG. 1 is shown. FIGS. 2A and 2B show the movable members in one position. The hair styling tool 10 preferably has movable members 24 in pairs, comprising a first movable member 24*a* and a second movable member 24*b*. The first and second movable members 24*a* and 24*b* are preferably connected and positioned at opposing sides of the core 16 and are movable together with respect to the core 16. More preferably, the first and second movable members 24*a* and 24*b* are joined with a connecting rod 36 through the core and slideable between opposing positions.

As shown in FIGS. 2A and 2B, in a preferred version of the invention, the hair styling tool 10 has a first movable member 24*a* positioned in the retracted position 28 when the second movable member 24*b* is positioned in the extended position 32. And, conversely, when the second movable member 24*b* is positioned in the retracted position 28 when the first movable member 24*a* is positioned in the extended position 32 and the pair of movable members 24*a* and 24*b* are connected and movable together between the opposing positions. Although FIGS. 2A and 2B show the movable members 24 in their fully extended and retracted positions, it will be understood by those of skill in the art that these are idealized drawings and that the movable members may move between positions that are substantially as shown and positions in between. In a more preferred version of the invention, the hair styling tool 10 has two or more pairs of movable members 24*a* and 24*b*, each pair of movable members being connected and positioned at opposing sides of the core, and movable with respect to the core. According to this version, the pair of movable members 24*a* and 24*b* are connected and positioned at opposing sides of the core 16, and at least a portion of the plurality of projections 20 are positioned in a row extending parallel to a longitudinal length 18 of the core 16 and between the pair of movable members 24*a* and 24*b*.

In a preferred version of the invention, the movable member 24, in the retracted position 28, is retracted to a position which is from about 0.25 inches beyond the projections 20 to a position which is substantially below the projections, depending to the type of projections 20 used in the hair styling tool 10, such as the type of bristle and tufting of the bristles, such that the hair will engage with the bristles. Preferably, the distal end 26 of the movable member 24 is from about 60% to 85% of the height of the projections 20 when the movable member 24 is in the retracted position 28. In the extended position 32, the movable member 24 extends to a position beyond the projections 20, which is from about 0.25 inches beyond the projections to about 1 inch beyond the projections, such that the hair disengages the bristles.

In an exemplary version of the invention, for a styling tool 10 having a core 16, which is about 1 inch (2.5 cm) in diameter, the projections 20 extend about 1.25 inches (3.2 cm) from the core 16. The movable member 24*a* extends about 0.875 inches (2.2 cm) from the core 16 when the movable member 24*a* is in the retracted position 28. The opposing movable member 24*b* extends about 1.625 inches (4.1 cm) from the core 16 when the movable member 24*a* is in the extended position 32.

Figure 3A:
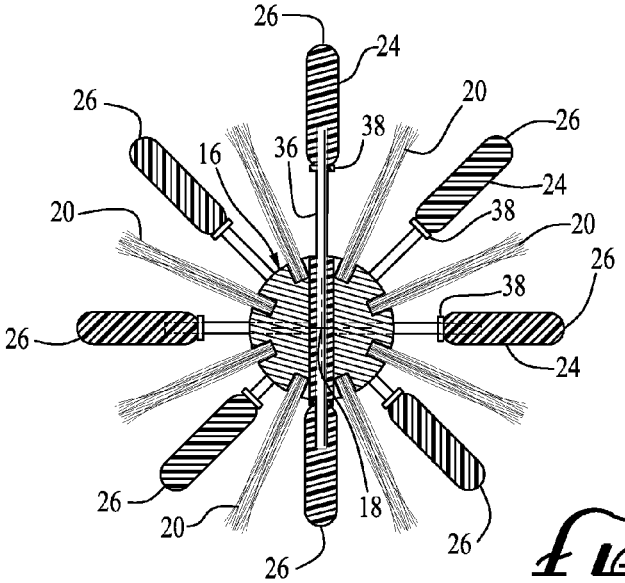
FIG. 3A is a sectional view of another version of the invention of the brush end shown in FIG. 1, taken through line 2-2 of FIG. 1.
Figure 3B:
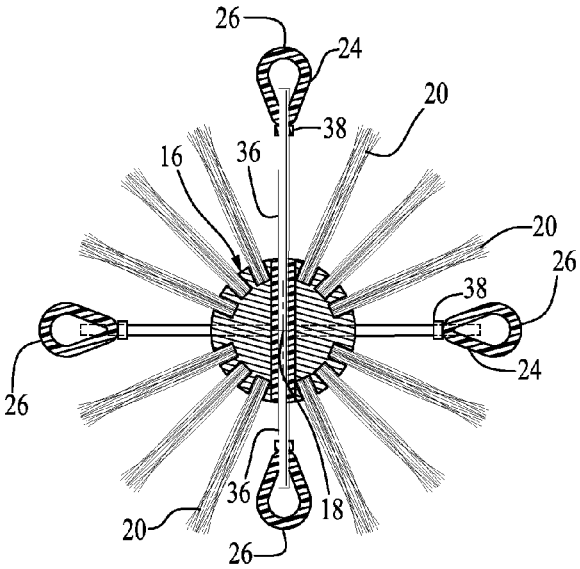
FIG. 3B is a sectional view of another version of the invention of the brush end of FIG. 1, taken through line 2-2 of FIG. 1.

Referring now to FIG. 3A and FIG. 3B, sectional views of versions of the brush end taken through a plane perpendicular to the longitudinal axis of the core 16 are shown. The core 16 is generally of a cylindrical shape, but may comprise other shapes which suitably incorporate the features of the invention, and may be comprised of a variety of materials including metal, for heat conduction, or plastic or wood, when heat conduction is not desired. The core 16 may also be coated to enhance smoothing and detangling. In a preferred version of the invention, the core is from a diameter of from about 0.5 inches (1.3 cm) to about 3 inches (7.6 cm), depending on the brushing application.

The projections 20 extend radially outward from the core 16 and may be attached to the core 16 in a conventional way, depending on the composition of the projections 20.

Preferably, the hair styling tool 10 has a plurality of projections 20 which are positioned in a row extending parallel to a longitudinal length of the core. More preferably, as shown in FIG. 3B, the projections 20 are three bristle clusters positioned in rows between each movable member 24. The plurality of projections 20 are generally a type of hair brush bristle including boar bristles, nylon or other plastic bristles, or a combination of bristle types, such as boar and plastic bristles. The boar and plastic bristles used in the present invention may be of varying stiffness for different brushing applications, such as soft bristles for thin or fine hair, and stiff bristles for thick or coarse hair. The nylon or plastic bristles may have rounded or balled ends to prevent scratching of the scalp, and boar and plastic or nylon bristles may be combined in one brush for yet other hair brushing applications. Other options may also be used for the projections, such as tourmaline, silicon or silicon coated bristles, or other bristle coatings which reduce fizz and enhance smoothing and detangling of the hair.

Figure 3C:
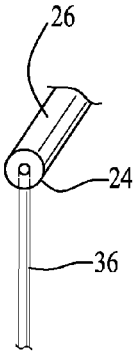
FIG. 3C and FIG. 3D are perspective sectional views of different version of the inventions of movable members of the brush end shown in FIG. 1.
Figure 3D:
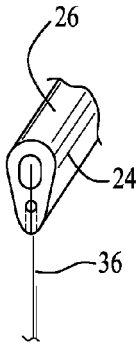

Referring again to FIGS. 3A and 3B, the distal end 26 of the movable member 24 may be of solid construction as shown in FIG. 3A, or may have a hollow interior, as shown in FIG. 3B. Referring now to FIGS. 3C and 3D, the distal end 26 of the movable member 24 may be of varying shapes, such as rounded, as shown in FIG. 3C, or an inverted rounded triangular shape, as shown in FIG. 3D, or other suitable shapes having a preferably rounded distal end 26. Further, the hair styling tool 10 may have a combination of shapes used for the distal end 26 of multiple movable members 24. The function of the movable member 24 is to prevent hair from tangling in the brush projections 20. Especially when hair is wet, rotation of the hair tool 10 can carry ends of the hair around the bristles of the hair styling tool 10. The hair ends then can get under other parts of the hair and tangle. The movable member(s) 24 smooth the bottom of the hair when the hair is in the retracted position 28 and push the hair outward when the movable member is in the extended position 32 which makes the hair less likely to tangle.

The movable member(s) 20 may also be formed of a material which retains heat. As hot air from a blow dryer hits the hair and the movable member(s) 20, the movable member(s) 20 warms and heat transfers back to the hair even when hot air from the blow dryer is directed elsewhere. In addition, the movable member(s) 20 may be preheated by aiming the hot air from a hair dryer at the movable member(s) 20 before directing air to the hair.

The distal end 26 of at least one movable member 24 may have a textured surface, or may be comprised of an elastomer such as silicone rubber or TPE to enhance smoothing and detangling of the hair. The distal end 26 may also be comprised of metal, plastic, nylon, wood or other suitable material and have a textured surface and/or an elastomeric coating or inset. The distal end 26 of the movable member 24 may be comprised of a material that retains heat, such that hot air from a blow dryer warms the divider and transfers heat back to the hair.

According to another version of the invention, as shown in FIG. 3B, the hair styling tool 10 may also have a damper 38 positioned between an inner portion of the movable member 24 and the core 16 to reduce vibration and noise when the movable member 24 moves between the retracted position 28 and the extended position 32.

Referring again to FIG. 1, the handle 12 may be of any shape convenient for brushing hair, preferably cylindrical in shape, and preferably comprised of a material which is resistant to corrosion and electrically insulating, such as plastic or wood. The handle 12 may additionally have cushioning and/or slip resistant features which are built into the handle or attached thereto, such as foam cushioning and/or slip resistant groves. The handle 12 may also have an anti-tangle collar 40.

According to another version of the invention, a rotating hair brush comprising a handle and a core having projections, such as bristles, and a movable divider is provided. The core is attached to the handle and is capable of rotating independent from the handle. The rotating hair brush may be manually rotatable, or may be powered by an electrical source.

Figure 4:
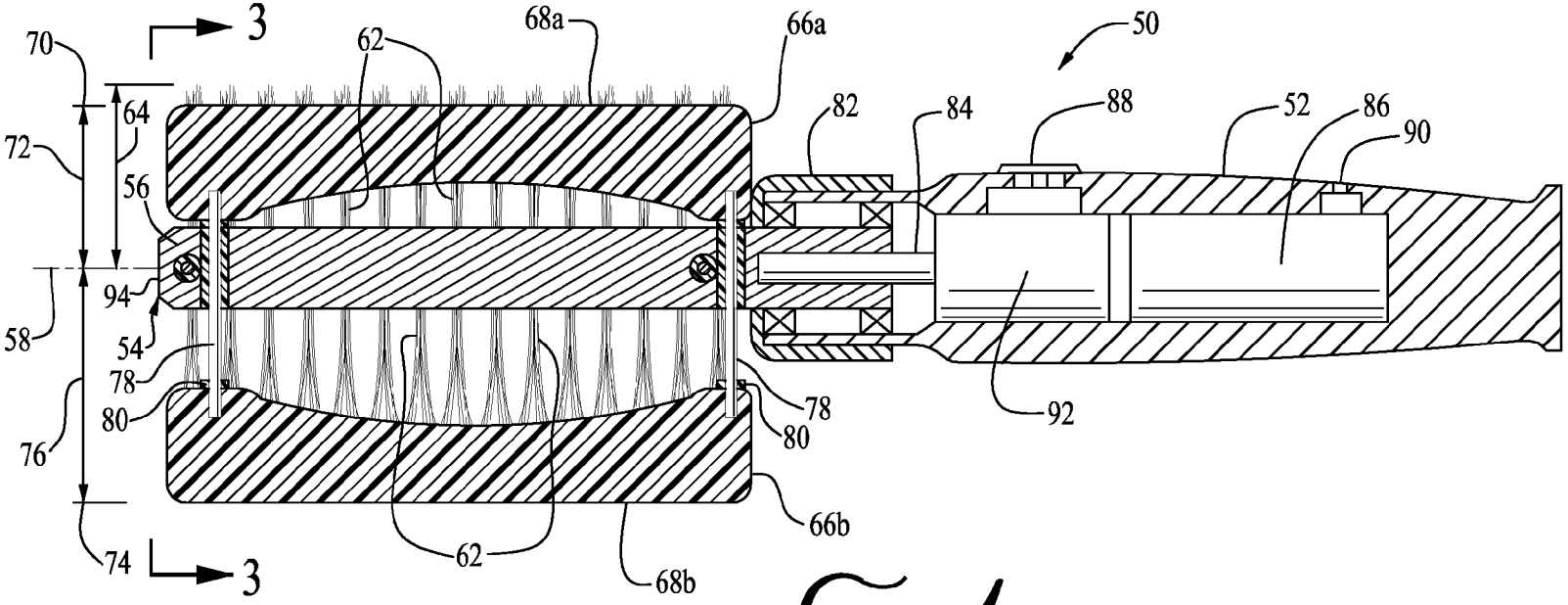
FIG. 4 is a side sectional view of a rotating hair brush, showing a pair of movable members having dampers according to another version of the present invention.

Referring now to FIG. 4, a side sectional view of a rotating hair brush 50, according to a preferred version is shown. The rotating hair brush 50 has a handle 52, a distal brush end 54, a core 56 having a longitudinal axis 58, and a rotation means 84 for rotating the core 56 about its longitudinal axis 58 relative to the handle 52. The rotating hair brush 50 has a plurality of projections 62 extending radially outwardly from the core 56 at a first distance 64 from the longitudinal axis 58 and movable members 66 having a distal surface 68. Preferably, the rotating hair brush has a pair of movable members, a first movable member 66*a* and a second movable member 66*b*, each movable member 66*a* and 66*b* having a distal surface 68*a* and 68*b* which extends radially outward from the core 56. The movable members 66*a* and 66*b* move between opposing positions including a retracted position 70 and an extended position 74. In the retracted position 70, the movable member distal surface 68 is distant radially from the longitudinal axis a second distance 72 that is less than the first distance 64. In the extended position 74, the movable member distal surface 68 is distant radially from the longitudinal axis a third distance 76 that is more than the first distance 64. Preferably, the first and second movable members 66*a* and 66*b* are positioned at opposing sides of the core 56 and connected therethrough with a connecting rod 78. More preferably, the movable members 66*a* and 66*b* and projections 62 on the rotating hair brush 50 are capable of engaging hair when the movable members 66*a* and 66*b* are positioned in the retracted position 70 and the movable members 66*a* and 66*b* are capable of pushing hair away from the core 54 and disengaging hair from projections 62 when the movable member 66 is positioned in the extended position 74.

As shown in FIG. 4, the rotating hair brush 50 may include dampers 80, which operate to reduce vibration and noise between the movable members 66 and the core 56. The rotating hair brush also includes a rotating means 84 for rotating the core 56 about its longitudinal axis 58 relative to the handle 52, and an optionally removable anti-tangle collar 82 capable of preventing hair from tangling at the rotation means 84 when core 56 is rotating relative to handle 52. The handle 52 may house an internal battery 86 or optionally, the rotating hair brush 50 may be directly powered by electricity from an electrical outlet, in which case the rotating hair brush 50 would also include a cord and plug for powering the device (not shown). When the rotating hair brush 50 includes a battery 86 for powering the brush, the battery 86 is preferably rechargeable, and the handle 52 includes a structure for mating with a recharging station (not shown). One or more switches 88 and 90 are located on the handle 52 for controlling the power to the brush's rotating means 84. One of the switches 88 or 90 may control the direction that the brush rotates, while the other switch may be used as on an/off switch, and/or to control brush speed. However, a single speed may be preferable, of from about 30 rpm to about 140 rpm.

The handle 52 may be made sections that are separable for access to the battery 86. Alternately, the battery 86 may be accessible through a removable door (not shown) in the handle 52. The rotating hair brush may also include an end cap 94 that closes the distal brush end 54 of the rotating hair brush 50. The end cap 94 may include an opening for receiving a motor shaft for rotating the core 56. However, as discussed herein, the motor and shaft may be alternately positioned within the hair brush 50.

The rotating means 84 may comprise a motor 92 for rotating the core 56 about its longitudinal axis 56 relative to the handle 52. The rotating means 84 may be located in the handle 52, as shown in FIG. 4, or alternately, the rotating means 84 may be located in the core 56 (not shown).

According to another version of the invention, the brush section may be removable from the handle 52. According to this version, brush heads with different brush designs, i.e., differing bristles or bristle arrangements may be used interchangeably with the handle 52. Further, when the distal brush end 54 is removable, the user may remove a brush for cleaning, or if the brush bristles break, the user can exchange a damaged brush end with a new brush end. The rotating hair brush may also include means for locking the distal brush end 54 to the handle 52, such as a detent fitting into an indentation, or a bayonet fitting also could be used. Preferably, the connection between the handle 52 and the brush end 54 is rigid so the brush end 54 does not wobble as it rotates. In general, the core 56 is positioned such that it is aligned along the same horizontal axis as the handle 52. However, in some versions, the core 56 and handle are fixed at a lesser angle, and in other versions, the core 56 may pivot with respect to the handle 52 such that the core 56 and handle 52 are positioned at an angle less than 180 degrees, such as an angle between about 175 degrees to about 90 degrees. Preferably, when the handle 52 pivots, the handle 52 will lock in place with respect to the core 56 in the different handle positions.

Figure 5C:
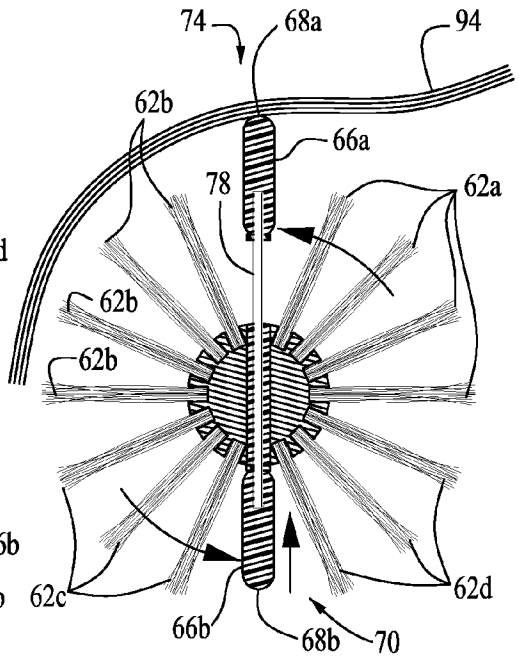
FIG. 5A, FIG. 5B, and FIG. 5C are sectional views of the rotating hair brush shown in FIG. 4, taken through line 3-3 of FIG. 4, showing bristles and a pair of movable members that engage and disengage a section of hair.
Figure 5B:
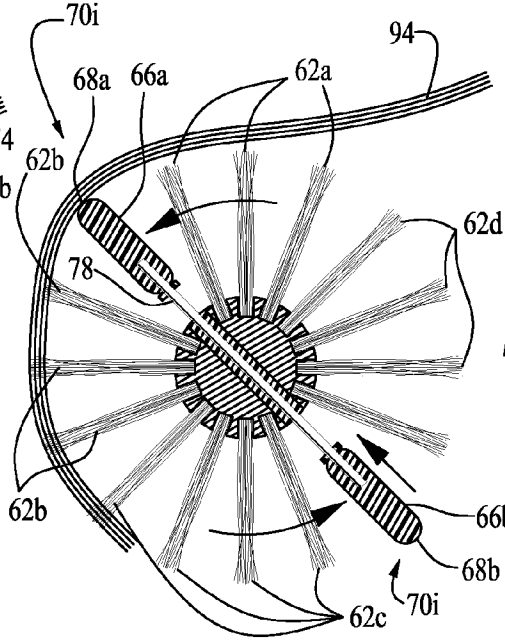
Figure 5A:
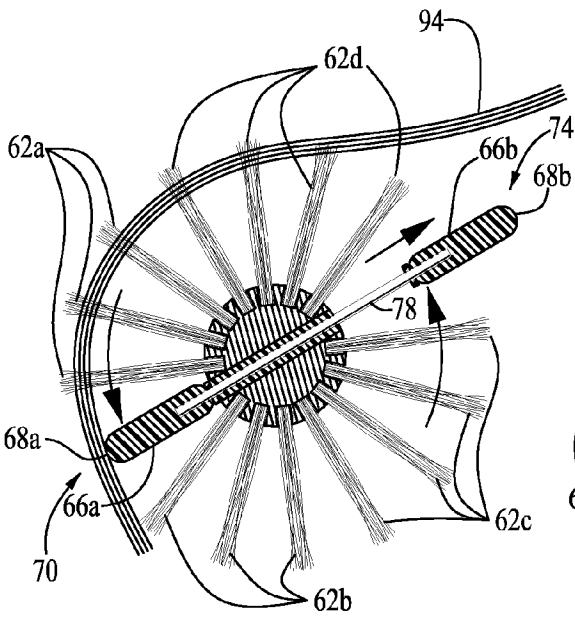

Referring now to FIGS. 5A, 5B and 5C, sectional views of the rotating hair brush 50 shown in FIG. 4 is shown, illustrating a method of brushing hair according to another version of the invention. As shown in FIGS. 5A, 5B, and 5C, the rotating hair brush 50 has a plurality of projections 62*a*, 62*b*, 62*c*, and 62*d* and a pair of movable members 66*a* and 66*b* that engage and disengage a section of hair 94.

According to the method, first, as shown in FIG. 5A, a section of hair 94 is contacted with a portion of the projections 62*a* and 62*b* on the rotating hair brush 50 when the first movable member 66*a* is positioned in the retracted position 70. As also shown in FIG. 5A, the second movable member 66*b* is in the extended position 74. The rotating hair brush 50 is then rotated, and optionally, the rotating means 92 is started (before or after the hair is contacted) causing the core 56 to rotate about the longitudinal axis 58. Alternately, the rotating brush 50 is manually rotated. Next, as the core 56 is rotated about the longitudinal axis 58, the projections 62*a* and 62*b* are pulled through the hair.

Next, as shown in FIG. 5B, the first movable member 66*a* moves to an intermediate position 70(*i*) where the first movable member 66*a* begins to extend to a position even with or slightly below or beyond the projections 62*a* and 62*b*, contacting the hair 94 with the distal end 68*a*. The second movable member 66*b* also moves to a second intermediate position 74(*i*) which is retracted from the extended position shown in FIG. 5A as the core 56 rotates.

Then, as shown in FIG. 5C, the first movable member 66*a* moves to the extended position 74 and the hair 94 is pushed away from the core 56 as the distal end 68*a* of the first movable member 66*a* extends beyond the projections 62*a* and 62*b*. As also shown in FIG. 5C, the second movable member 66*b* moves to the retracted position 70 as the core 56 rotates and the projections 62*c* and 62*d* begin to engage the hair 94.

Thus, according to the method, the movable members 66*a* and 66*b* and projections 62*a* and 62*b* on the rotating hair brush 50 are capable of engaging hair 94 when the movable members 66*a* and 66*b* are positioned in the retracted position 70 and the movable members 66*a* and 66*b* are capable of pushing hair away from the core 56 and disengaging hair 94 from projections 62*a* and 62*b* when the movable member 66 is positioned in the extended position 74.

According to another version, the invention comprises a rotating hair brush having a movable member, as described herein and further comprises a heating means for heating the hair while brushing. Examples of the heating means comprises a heating element within or integral with the core such that the core may be heated while the rotating hair brush is in use, and/or a heated blower which may be within or integral with the handle, or otherwise situated to provide hot air venting (i.e., moving) out from the core or otherwise blowing out hot air such that the hair is heated with hot air while the rotating hair brush is in use. When the version of the rotating hair brush having a heating means is used according to the method of the invention, the heating means is started before or after the hair is placed in the projections (e.g., bristles), of the hair styling tool and when the hair is brushed, the heating means causes heat to be delivered to the core.

Figure 6:
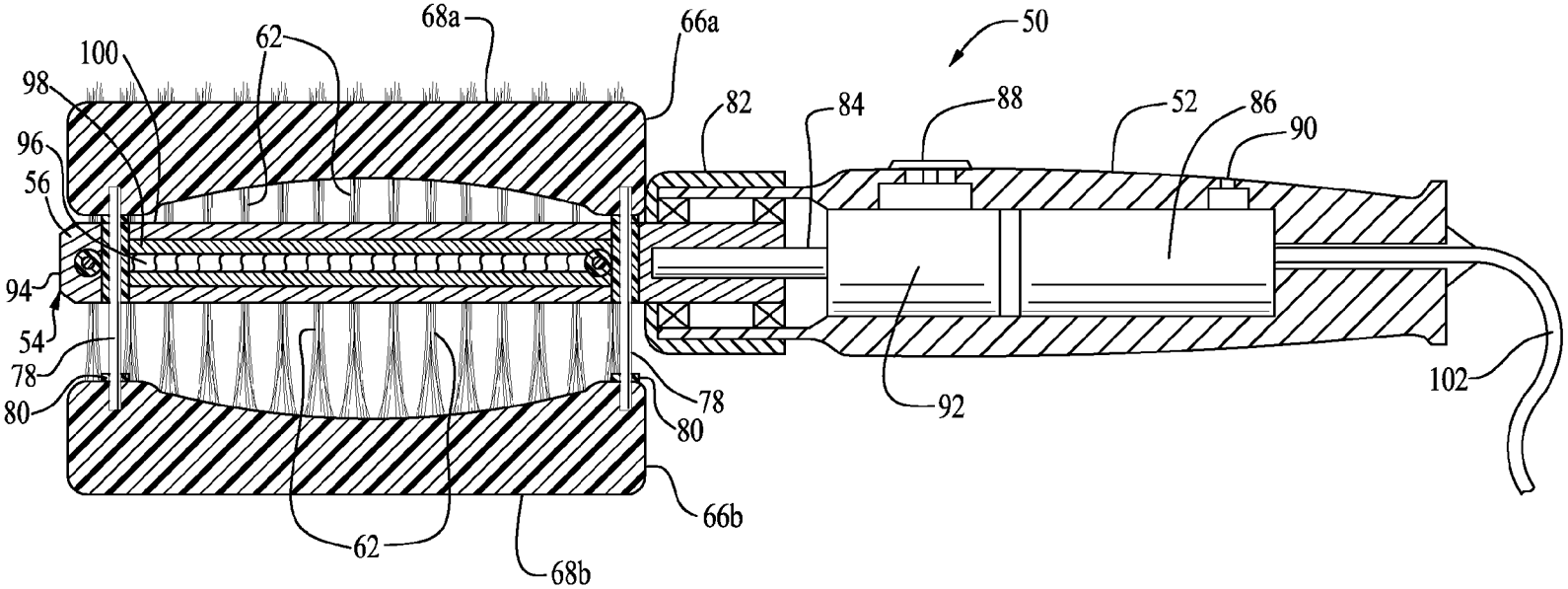
FIG. 6 is a side sectional view of the hair styling tool shown in FIG. 4, having a heating element which is integral with the core.

Referring now to FIG. 6, another version of the rotating hair brush 50 shown in FIG. 4 is shown, having an exemplary version of the heating means. According to this exemplary version of the invention, the heating means is a heating element, shown as a heating rod 96 which is integral, or integrated within the brush end 54 and adapted to provide heat to the core 56. According to this exemplary version, the brush end 54 includes a heat transfer assembly 98 which is positioned between the outer surface 100 of the core 56 and the heating rod 96. The heat transfer assembly 98 comprises a suitable heat transfer material, such as metal, ceramic, or other suitable heat transfer materials. When the heating element 96 is heated, the heat is transferred to the heat transfer assembly 98 and to the outer surface 100 of the core 56. One or more of the switches 88 and 90, located on the handle 52, in addition to controlling the power to the brush's rotating means 84, may also control power to the heating rod 96, and/or may be used as on an/off switch. Further, the switch controlling the heating rod 96 may also include varying ranges of temperature from hot to cool positions. Although two switches are shown and described herein, other combinations of switches, or a single multi-purpose switch may be used on the rotating hair brush 50 with heating means. The rotating hair brush may also be electrically connected to a power source, such as the power cord 102 to provide heat to the heating rod 96 and/or to power the rotating means 84 and/or to control brush speed. However other power sources may be used to heat and rotate the brush as described herein. Other examples of a hair styling tool having a heating element may be seen in U.S. Pat. Nos. 7,631,646; and 7,481,228, the entire disclosure of which is hereby incorporated by reference. Further, although the present disclosure describes a heating element which transfers heat to the outer surface 100 of the core 56 via a heat transfer assembly 98, other heating means and heating elements, such as a radiant heating element, are within the scope of the present invention, as will be understood by those of skill in the art.

Figure 7:
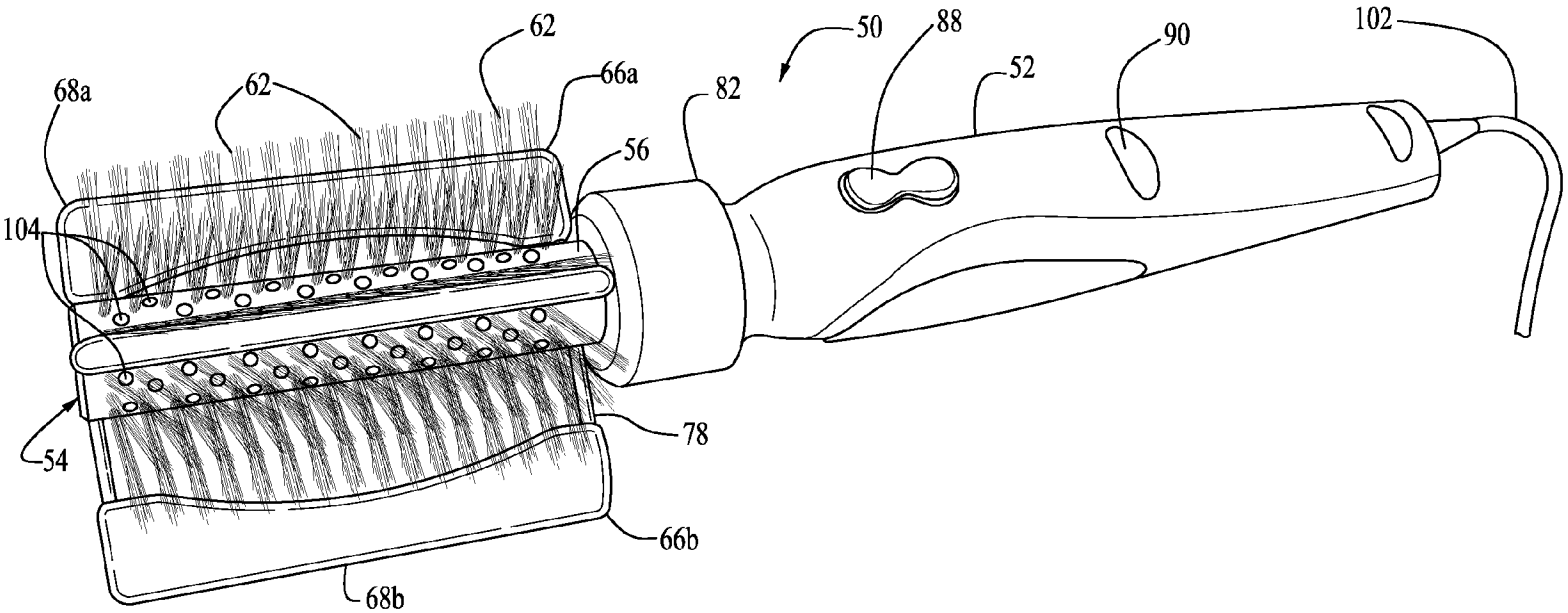
FIG. 7 is a perspective view of the hair styling tool shown in FIG. 4, having a heated blower and a vented core which provides hot air venting out the core.

Referring now to FIG. 7, a perspective view of another version of the rotating hair brush 50 shown in FIG. 4 is shown, having an exemplary version of the heating means. According to this exemplary version of the invention, the heating means is a heated blower. According to this exemplary version of the heating means, the components of the hair brush are configured to provide a substantially unobstructed flow of air through apertures 104 in the core 56 of the rotating hair brush 50. According to this version, the heating means comprises a heated blower, which may include a heater assembly 106 (not shown) and a fan assembly 108 (not shown). The heater assembly 106 extends from the fan assembly 108, to within the core 56. In one exemplary version, the heater assembly 106 performs as a resistor to which current is supplied via and power cord 102 or other means, such as battery. The interior of the core 56 may be equipped with heating elements such that air forced through the heating assembly 106 can be heated and forced through the apertures 104 in the core 56 for the purpose of both drying and styling hair. In addition to heating the core 56 and hair exposed to apertures 104, the heating assembly may also be capable of heating the movable dividers **66*a* and 66*b*** in certain versions of the invention.

One or more of the switches 88 and 90, located on the handle 52, in addition to controlling the power to the brush's rotating means 84, may also control power to the heater assembly 106 and the fan assembly 108, and/or may be used as on an/off switch. The switch controlling the heater assembly 106 may also include varying ranges of temperature from hot to cool positions. Although two switches are shown in FIG. 7, other combinations of switches or a single multi-purpose switch may be used on the rotating hair brush 50 with heating means.

As also shown in FIG. 7A, the brush end 54 includes a plurality of projections 62 extending from the core 56. Also included on the brush end 54 are a plurality of apertures 104 which provide a path for the flow of air from within the core 56 of the rotating hair brush 50 to the exterior of the core, or otherwise venting out hot air such that the hair is heated with hot air while the rotating hair brush is in use. According to this exemplary embodiment, the core 56 has within it a hollow cavity that allows for the flow of heated air.

Advantages of the hair styling tool described herein include the ability of the tool to eliminate tangling while brushing while the hair is being dried, or "blown out" and "styled" with a hand held hair dryer with brushing regardless of hair section size, hair length or brush placement. The design of the rotating hair tool allows the bristles to freely engage a section of hair that is intended to be brushed when the movable member is in the retracted position. Then, as the brush end rotates, the hair encounters a movable member in the extended position and any hair currently engaged in the bristles adjacent to the extended movable member will be pushed out and away from the bristles, thus eliminating tangling in the area of the brush immediately adjacent to the extended movable member. The distal ends of the movable members further serve to concentrate heat and smooth hair while under tension against hair as the brush end rotates. The pattern of bristles engaging and disengaging the hair as the movable member moves from the fully extended to retracted positions, relative to the bristles, ensures that the hair is effectively brushed without tangling. In addition, the rotating hair tool can be used effectively at a variety of angles so that a user can brush and dry his/her own hair, even at odd angles, such as the back of their own hair. Accordingly, the rotating hair tool can be used to apply proper tension on the hair, and when heat is applied during the blow out, even frizzy and otherwise unmanageable hair can achieve a sleek, glossy appearance which can last for several days. Further, with the hair styling tool according to the invention, an entire head of hair can be blown out and styled with professional looking results on one's own head of hair, thus lessening trips to the salon for a professional blow dry, which can be a significant cost savings to the user.

In certain versions of the invention comprising a heating means, the hair may be heated and styled without the use of a hair dryer, which is highly convenient for the user. In other versions of the invention having a heated blower, the hair may be simultaneously dried and styled. This is a significant time savings for the user.

Although the present invention has been discussed in considerable detail with reference to certain preferred versions of the invention, other versions of the invention are possible. For example, the size and shape of the movable dividers may be varied, as well as the type and length of bristles, the means of rotation, the shape of the brush head, and/or the heating means. Therefore, the scope of the appended claims should not be limited to the description of preferred versions of the invention contained herein.

What is claimed is:

1. A hair styling tool comprising:

a) a handle;

b) a brush portion having a first end and a second end attached to the handle, the brush portion comprising a longitudinal axis extending between the first and second ends;

c) a plurality of projections extending radially outwardly from the brush portion at a first fixed distance from the longitudinal axis; and d) at least one pair of movable members comprising a first movable member and a second movable member wherein the first and second moveable members are positioned at opposing sides of the brush portion and the longitudinal axis and are connected to each other through the brush portion, the first movable member and the second movable member each extending radially outward from the brush portion to a distal end having a distal surface, where the distal surfaces of the first and second moveable members extend continuously from a first end to a second end and the first and second ends of the distal surfaces are respectively positioned in a vicinity of the first and second ends of the brush portion and wherein the pair of movable members move together between opposing positions, the opposing positions comprising:

(i) a retracted position wherein the movable member distal surface is distant radially from the longitudinal axis at a second distance that is less than the first fixed distance, and (ii) an extended position wherein the movable member distal surface is distant radially from the longitudinal axis at a third distance that is more than the second distance, wherein the pair of movable members move together between opposing positions such that when the first movable member moves from its extended position to its retracted position, the second movable member moves together with the first movable member from its retracted position to its extended position, and when the second movable member moves from its extended position to its retracted position, the first movable member moves together with the second moveable member from its retracted position to its extended position.

2. The hair styling tool according to claim 1 wherein the tool comprises two or more pairs of movable members, each pair of movable members being connected and positioned at opposing sides of the brush portion, and movable with respect to the brush portion between opposing retracted and extended positions.

3. The hair styling tool according to claim 1 wherein at least one of the movable members further comprises a damper positioned between an inner portion of the movable member and the brush portion to reduce vibration and noise between the moveable member and the brush portion.

4. The hair styling tool according to claim 1 wherein the projections are bristles.

5. The hair styling tool according to claim 1 wherein at least a portion of the plurality of projections are positioned in a row extending parallel to a longitudinal length of the brush portion and between the pair of moveable members.

6. The hair styling tool according to claim 1 wherein the distal surface of the movable members comprises a textured surface.

7. The hair styling tool according to claim 1 wherein the first and second movable members are connected with a connector.

8. The hair styling tool according to claim 1 further comprising a heating means.

9. The hair styling tool according to claim 8 wherein the heating means is a heating element.

10. The hair styling tool according to claim 8 wherein the heating means is a heated blower.

11. The hair styling tool according to claim 1, further comprising means for rotating the brush portion about its longitudinal axis relative to the handle.

12. The hair styling tool according to claim 1, wherein the moveable members are connected to each other with two connectors extending through the brush portion, thus moving in unison.

13. The hair styling tool according to claim 1, wherein the moveable members are located between the projections.

14. A hair styling tool comprising:

a) a handle;

b) a brush portion having a first end and a second end attached to the handle and a longitudinal axis extending between the first and second ends;

c) means for heating the brush portion;

d) a motor for rotating the brush portion about its longitudinal axis relative to the handle;

e) a plurality of projections extending radially outwardly from the brush portion at a first fixed distance from the longitudinal axis; and f) at least one pair of movable members comprising a first movable member and a second movable member wherein the first and second moveable members are positioned at opposing sides of the brush portion and the longitudinal axis and are connected to each other through the brush portion, the first movable member and the second movable member each extending radially outward from the brush portion to a distal end having a distal surface, where the distal surfaces of the first and second moveable members extend continuously from a first end to a second end and the first and second ends of the distal surfaces are respectively positioned in a vicinity of the first and second ends of the brush portion and wherein the pair of movable members move together between opposing positions, the opposing positions comprising:

(i) a retracted position wherein the movable member distal surface is distant radially from the longitudinal axis at a second distance that is less than the first fixed distance, and (ii) an extended position wherein the movable member distal surface is distant radially from the longitudinal axis at a third distance that is more than the second distance, wherein the pair of movable members move together between opposing positions such that when the first movable member moves from its extended position to its retracted position, the second movable member moves together with the first movable member from its retracted position to its extended position, and when the second movable member moves from its extended position to its retracted position, the first movable member moves together with the second moveable member from its retracted position to its extended position.

15. The hair styling tool according to claim 14 wherein the heating means is a heating element.

16. The hair styling tool according to claim 14 wherein the heating means is a heated blower.

17. The hair styling tool according to claim 14, wherein the moveable members are located between the projections.

18. The hair styling tool according to claim 14, wherein the moveable members are connected to each other with two connectors extending through the brush portion.

19. A method of brushing hair comprising the steps of:

a) placing the projections of the hair styling tool of claim 14 in hair;

b) before or after step (a), starting the motor to cause the brush portion to rotate; and c) pulling the projections through the hair with the rotatable brush portion rotating, wherein at least one movable member moves between the extended position and the retracted position so that in the extended position, the moveable member pushes hair away from the projections to keep hair from tangling in the projections.

20. The method according to claim 19 further comprising before or after step (a), starting the heating means to cause heat to be delivered to the brush portion.

21. The method of claim 19 wherein the pulling of the projections through the hair with the rotatable brush portion rotating causes the hair to be polished and smoothed.

22. A hair styling tool comprising:

a) a handle;

b) a brush portion having a first end and a second end attached to the handle, the brush portion comprising a longitudinal axis extending between the first and second ends;

c) a plurality of projections extending radially outwardly from the brush portion at a first fixed distance from the longitudinal axis; and d) a first movable mechanism and a second movable mechanism positioned at opposing sides of the brush portion and the longitudinal axis and connected to each other through the brush portion, the movable mechanisms extending radially outward from the brush portion to distal ends, each distal end having a distal surface, the distal surfaces extending continuously along the length of the longitudinal axis of the brush portion such that an end of the distal surface is disposed in a vicinity of the first end of the brush portion and another end of the distal surface is disposed in a vicinity of the second end of the brush portion, and wherein the movable mechanisms move together between opposing positions, the opposing positions comprising:

(i) a retracted position wherein the movable mechanism distal surface is distant radially from the longitudinal axis at a second distance that is less than the first fixed distance, and (ii) an extended position wherein the movable mechanism distal surface is distant radially from the longitudinal axis at a third distance that is more than the second distance, wherein the movable mechanisms move together between opposing positions such that when the first movable mechanism moves from its extended position to its retracted position, the second movable mechanism moves together with the first movable mechanism from its retracted position to its extended position, and when the second movable mechanism moves from its extended position to its retracted position, the first movable mechanism moves together with the second moveable mechanism from its retracted position to its extended position.

23. The hair styling tool according to claim 22 wherein at least one of the movable mechanisms further comprises a damper positioned between an inner portion of the movable mechanism and the brush portion to reduce vibration and noise between the moveable mechanism and the brush portion.

24. The hair styling tool according to claim 22, wherein the moveable mechanisms are connected to each other with connectors extending through the brush portion, thus moving in unison.

25. The hair styling tool according to claim 22, wherein the moveable mechanisms are located between the projections.

* * * * *